US005634591A

United States Patent [19]

Brown

[11] Patent Number: 5,634,591

[45] Date of Patent: Jun. 3, 1997

[54] SLIDING JOINT SYSTEM FOR RAILWAY TRACKS, ALLOWING A GREAT LONGITUDINAL EXCURSION, PARTICULARLY FOR SUSPENSION BRIDGES

[75] Inventor: William Brown, London, Great Britain

[73] Assignee: Stretto Di Messina S.p.A., Rome, Italy

[21] Appl. No.: 428,134

[22] PCT Filed: Oct. 27, 1993

[86] PCT No.: PCT/EP93/02984

§ 371 Date: May 26, 1995

§ 102(e) Date: May 26, 1995

[87] PCT Pub. No.: WO94/10383

PCT Pub. Date: May 11, 1994

[30] Foreign Application Priority Data

Oct. 28, 1992 [IT] Italy ..... MI92A2467

[51] Int. Cl.[6] ..... E01B 11/42

[52] U.S. Cl. ..... 238/171

[58] Field of Search ..... 238/151, 171, 238/172, 173, 174, 187; 104/123, 124

[56] References Cited

U.S. PATENT DOCUMENTS

| | | | |
|---|---|---|---|
| 411,362 | 9/1889 | Weir | 238/171 |
| 2,067,598 | 1/1937 | Clarke | 238/171 |
| 4,171,774 | 10/1979 | Deslauriers | 238/171 |
| 4,785,994 | 11/1988 | Crone et al. | 238/171 |

FOREIGN PATENT DOCUMENTS

| | | | |
|---|---|---|---|
| 48463 | 1/1911 | Austria | 238/171 |
| 1298311 | 11/1962 | France | 238/171 |
| 2185192 | 12/1973 | France | 238/171 |
| 9323624 | 11/1993 | WIPO | 238/171 |

*Primary Examiner*—S. Joseph Morano
*Attorney, Agent, or Firm*—Young & Thompson

[57] ABSTRACT

Sliding joint system in a railway track allowing a great longitudinal excursion—particularly for suspension bridges—comprising, for each rail of the track, a first fixed rail (1) having an end tapered on the outwardly facing sides of the track, and a second rail (2) positioned next to the tapered surface of the first rail (1) and sliding along the same, while continuously extending beyond the tapered surface in an oblique direction, outwardly of the track, at an acute angle. The base flange of the second rail (2) is preferably of reduced width, equal to that of its head, so as to be more flexible. The deviation and sliding of the second rail (2) in respect of the first rail (1) are ensured by guides comprising: a first set of three guide rollers (3, 4, 5) meant to align the second rail (2) parallel to the main longitudinal axis of the track; a plurality of secondary rollers (6) with fixed vertical axes, positioned so as to face the tapered surface of the first rail (1); and pairs of coupled guide rollers (7), positioned at regular intervals along a first guide channel (8) of the second rail (2). The second rail (2) thus bends into and out of alignment with the first rail (1), upon thermal extension or contraction of the bridge, thereby to accommodate great variations in the length of the bridge whilst maintaining continuous tracks.

8 Claims, 4 Drawing Sheets

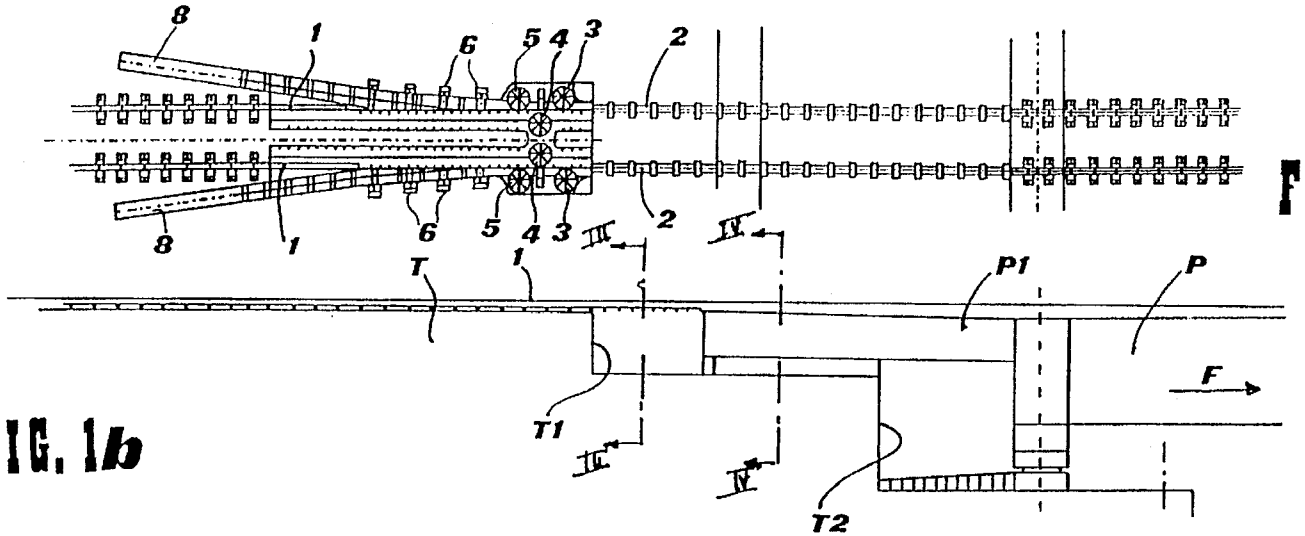
FIG. 1a
FIG. 1b
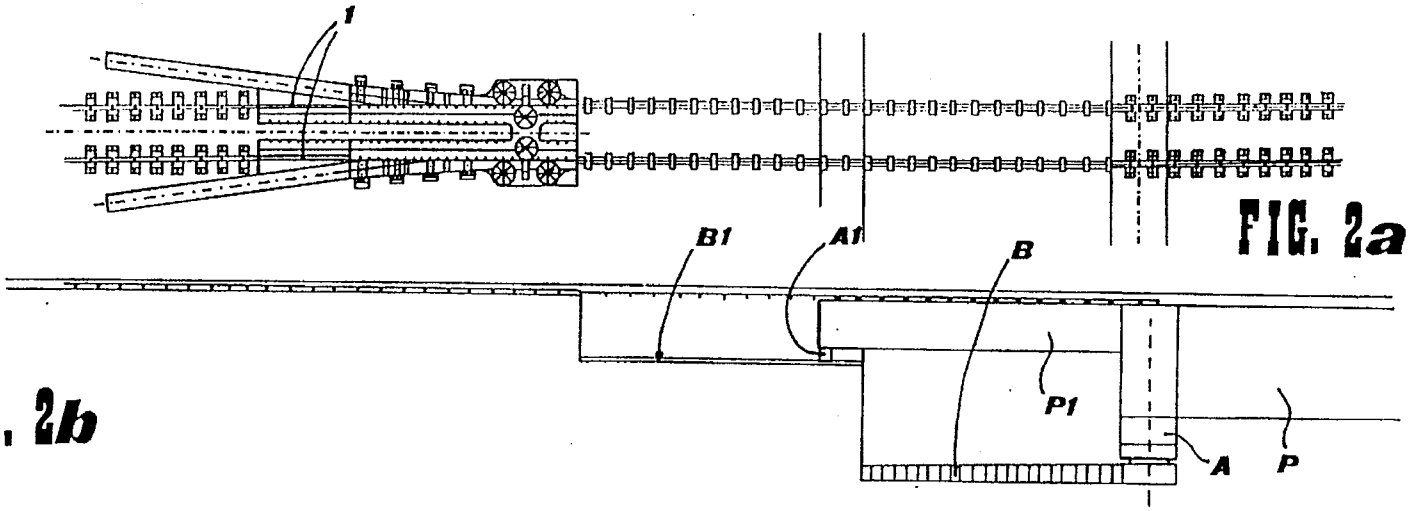
FIG. 2a
FIG. 2b

SLIDING JOINT SYSTEM FOR RAILWAY TRACKS, ALLOWING A GREAT LONGITUDINAL EXCURSION, PARTICULARLY FOR SUSPENSION BRIDGES

The present invention concerns suspension bridges comprising an essentially flat main structure, or framework, the top surface of which forms the roadway for the transport means crossing the bridge, and a suspension system formed of catenary cables anchored to end piers of the bridge and of a plurality of vertical stays or hangers to suspend the bridge framework to the catenary cables.

As known, the longer the suspension bridge, the greater the longitudinal excursion it undergoes, mainly due to thermal expansions, live load variations on the bridge, and/or displacements caused by the action of the wind.

The invention thus relates, in particular, to a sliding joint system for railway tracks, allowing a great longitudinal excursion—in theory, unlimited—of one track section in respect of the other.

The problem of longitudinal excursion essentially arises in correspondence of the end piers onto which are anchored the catenary cables to suspend the bridge, whereby sliding joints have to be provided in these areas.

As concerns the sliding joints for roadways, there are already known to be systems allowing considerable excursions. These systems generally consist of parallel intersecting tracks, which are considered to provide a satisfactory solution to the problem.

Whereas, as concerns railways, the only known system allowing a certain reciprocal sliding between the rails—while still ensuring a constant support of the train wheels—consists in tapering the opposed ends of the two railroad sections and placing said tapered ends side by side; the discontinuity between the two rails thus appears in the form of an oblique cut (instead of being perpendicular to the rail axis). The narrower the angle formed between the axis of said cut and the rail axis—i.e. the more marked the tapering—the greater the excursion allowed by such a joint system. In any case, there are no joints of this type allowing an excursion of more than a few decimeters.

From the documents U.S. Pat. No. 2,067,598 and FR-A-2185192, joints are also known in which only one of the adjacent ends of the rails is obliquely cut, while the other end runs close to this oblique surface and along the same. The advantage of this system is provided by the fact that there is always a contact between the two rails, differently from the above cited known technique in which the ends of the rails are separated by an oblique slot and the width of this slot becomes greater as the ends of the rails more apart one from the other due to contraction of the rails, i.e. owing to cooling.

Even if these known systems, as already said, have this advantages to avoid the formation of a more or less wide slot between the ends of the rails, however, they do not allow wide longitudinal excursions between the rails. In U.S. Pat. No. 2,067,598 (page 2, column 2, lines 23, 24) it is said that the longitudinal excursion may be of about 400 mm. and also a less wide longitudinal excursion is foreseen in FR-A-2185192 (see the broken lines a in FIG. 2).

In fact, all the above systems are provided for extensions and contractions of the rails caused in particular by thermal variations. Besides in these conditions—seen from another point of view—the movements of the rails are, as known, extremely slow: normally there is only an extension during the day and a contraction during the night. Therefore the resistance to sliding of the rails, owing to the great friction between them, is practically negligible.

However, in suspension bridges with a very wide span, for instance over 1 Km, one should provide excursions of the order of meters. In the bridge being planned for crossing the Straits of Messina—to which reference is made in EP-A-0.233.528, filed by the same Applicant—having a span greater than 3 Km, the reckoned excursion is of ±3.5m in rest conditions, with no traffic on the bridge. But it is perfectly known that, in railway technique, there is no joint system allowing an excursion of 7 m.

Besides, in the case of a joint for a suspension bridge with a very wide span, the sliding of the rails is determined, not only by the thermic variations, but also by the movements to which the bridge is subjected both owing to the load variations (which cause the flexion on the vertical plane), and to the wind action (which causes a lateral pressure and then flexions in the horizontal plane). Then these movements, besides being very wide, may happen also much more frequently and in relatively short times, i.e. depending on the traffic and on the wind. For this reason the friction problem between one rail and the next assumes a great importance.

The object of the present invention is therefore to propose a sliding joint system for railway tracks, allowing a wide longitudinal excursion—in theory unlimited, but anyhow sufficient to satisfy the requirements of modern suspension bridges—while constantly ensuring a correct support and a precise guiding of the train wheels.

Further characteristics and advantages of the railway sliding joint according to the present invention will anyhow be more evident from the following detailed description of a preferred embodiment thereof, given by way of example and illustrated in the accompanying drawings, in which:

FIGS. 1*a* and 1*b* are diagrammatic plan and, respectively, elevation views of the railway sliding joint system according to the invention in an intermediate position of excursion;

FIGS. 2*a* and 2*b* are similar views in a final position of excursion;

Figure 4:
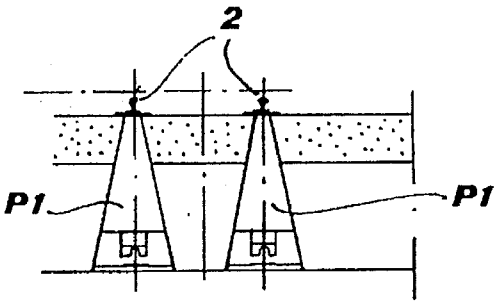
FIGS. 3 and 4 are diagrammatic section views along the line III—III and, respectively, IV—IV of FIG. 1*b;*

As shown in the drawings, the railway sliding joint system according to the present invention comprises a so-called fixed track section 1—1 and a slidable track section 2—2. FIGS. 1 and 2 show the section 1—1 as being integral with the embankment T, while the section 2—2 is integral with the bridge part P-P1 which is slidable along the platforms B-B1 by way of the supports A-A1.

From the position shown in FIG. 1, the bridge end P can move in the direction of arrow F—i.e. when subject to contraction—as far as the final position shown in FIG. 2, with the support A sliding along platform B up to reaching its outermost end. At the same time the longitudinal beam P1, forming an extension of the bridge P, slides with its support A1 along platform B1. On the contrary, when the bridge end P moves in a direction opposite to arrow F—i.e. while elongation takes place—the supports A-A1 move as far as the platform heads T1, T2.

Figure 3:
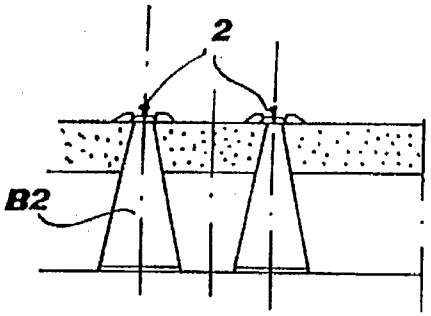

FIGS. 3 and 4 show the tip-shaped section of the longitudinal beam P1, which slides telescopically into a guide channel B2. The slidable rail 2 is fixed on the tip of the beam P1.

Figure 5:
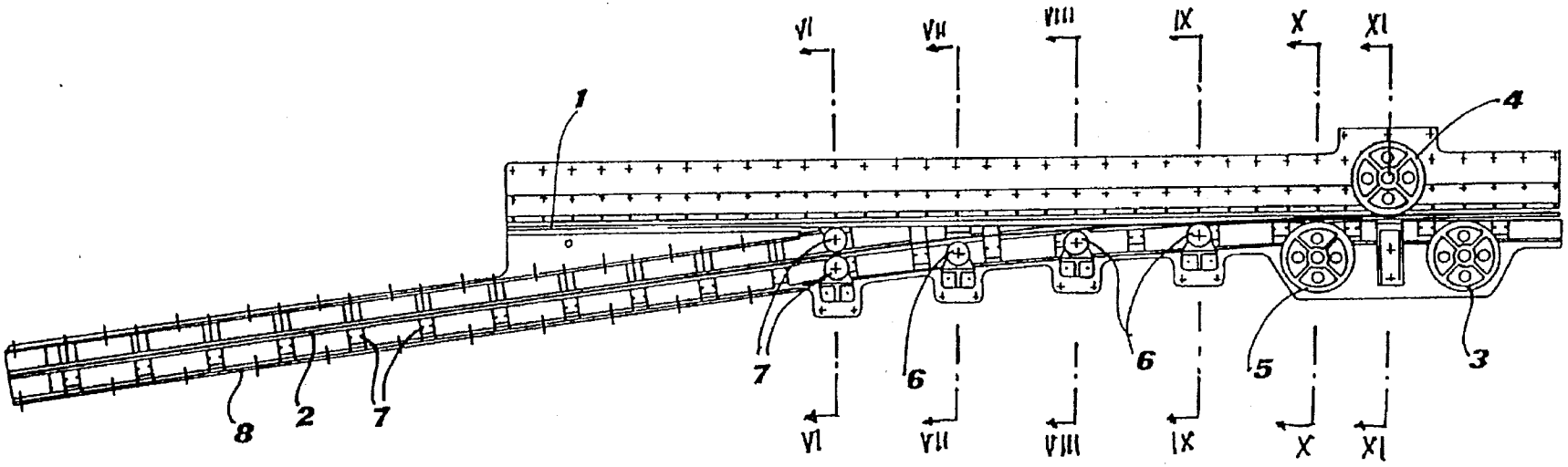
FIG. 5 is a diagrammatic plan view, on an enlarged scale, of the area comprising the sliding joint system according to the invention.
Figure 6:
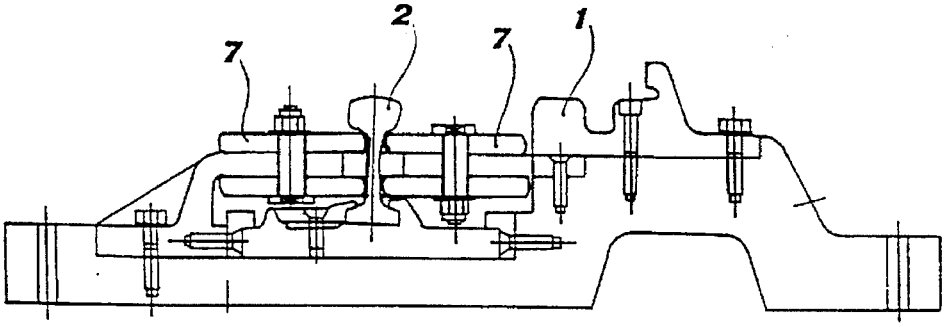
FIGS. 6 to 11 are diagrammatic section views along the lines VI—VI to XI—XI of FIG. 5.
Figure 7:
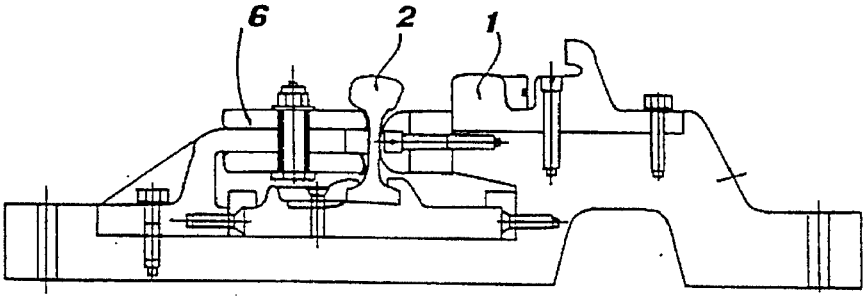
Figure 8:
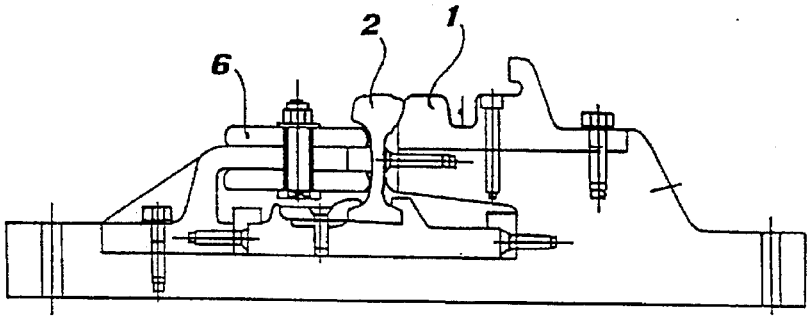
Figure 9:
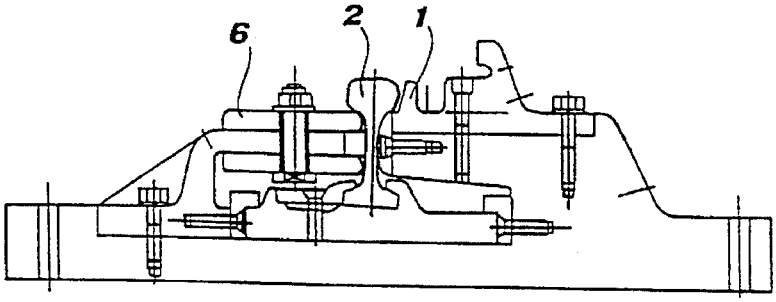
Figure 10:
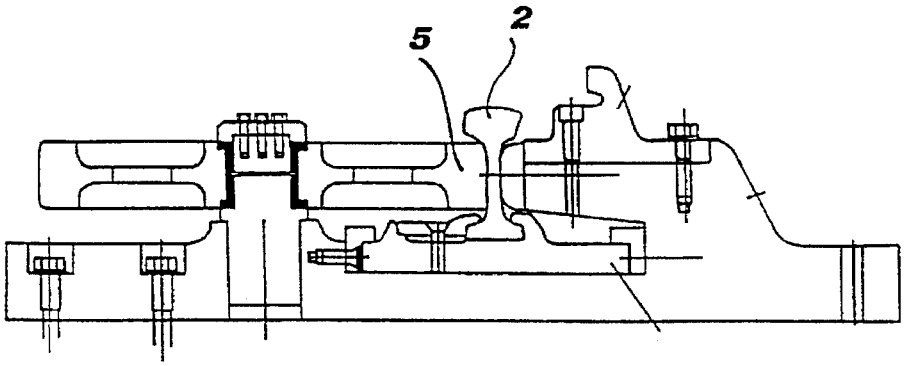
Figure 11:
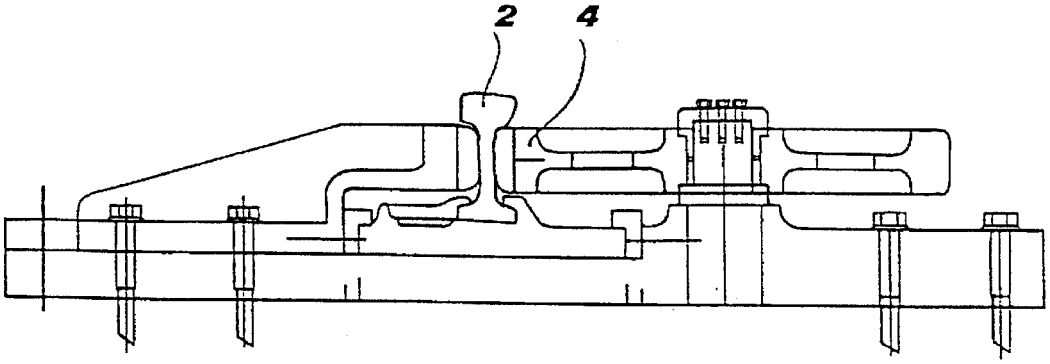

As shown more clearly in the plan view of FIG. 5 and in the section views of FIGS. 6 to 11 (which refer to the rails 1-2 illustrated in the lower half of FIGS. 1*a* or 2*a*, but—by symmetry—also to the rails 1-2 illustrated in the top half of these figures), the sliding joint system of the present invention comprises, in a characteristic way:

on the one hand, the fixed rail 1 which is beveled, i.e. comprises a very marked tapering which practically extends between a point just before the section line VIII—VIII (FIG. 8 shows in fact where the bevel starts) and a point just before the section line X—X (FIG. 10 shows in fact only the rail 2, as the tapered portion of the rail 1 has terminated);

on the other hand, the slidable rail 2, which is positioned next to the tapered portion of the rail 1, without being tapered itself (as clearly shown in FIGS. 6 to 11), but rather bending and deviating outwardly of the track at an acute angle, guided along and sliding against the tapered surface of the rail 1.

Although the rail 1 has a stiffened structure (as shown in the sections of FIGS. 6–10), it would not be sufficient to stand the pressure forces of the rail 2 due to its deflection. To endure this outward deflection, the rail 2 is thus constantly guided also:

by a set of three main rollers 3, 4, 5, which are also meant to align the rail 2 parallelly to the main longitudinal axis of the track, in a position preceding the zone of outward deviation;

by a plurality of secondary guide rollers 6, positioned so as to face the tapered surface of the rail 1; and finally by pairs of guide rollers 7, positioned at regular intervals along a channel 8 meant to guide and protect the rail 2.

To be able to work correctly, the sliding joint system according to the invention must comprise a rail 2 adapted to undergo the foreseen progressive deflections or straightenings, while keeping within the range of its elastic limits. In other words, it is evident from the above that the rail 2—which undergoes a certain temporary deflection—should always be able to elastically recover its rectilinear configuration.

To favor said deflection, the rail 2 is preferably formed with a flange of reduced width, for instance the same width of the head (as clearly visible in FIGS. 6 to 10), so as to improve the deformability by lateral elastic deflection, though allowing to keep the induced stresses within acceptable limits, also taking into account the fatigue strength.

Reverting briefly to FIG. 1 it can be noted that, in the intermediate position of FIG. 1*a*, the rail 2 extends into the channel 8 for about half of its length; while in the final position of FIG. 1*b*, the channel 8 is completely free in that the rail 2, together with the bridge P, is fully set back (maximum contraction of the bridge) whereby its end part finds itself in contact with the rollers 6. In a fully advanced position of the bridge (maximum elongation)—not shown in the drawings—the rail 2 would occupy the whole channel 8.

It is anyhow to be understood that the invention is not limited to the particular embodiment described heretofore, which is only a non-limiting example of its scope, but that many other embodiments are possible—both as to the positioning of the guide channel 8, which could be on the inner side of the track instead of being on it outer side, and above all as to the guide means of the rail 2—all these embodiments being within reach of a technician skilled in the art and thus falling within the protection field of the present invention.

I claim:

1. A railway track comprising a first fixed rail having an end which is chamfered on an outwardly facing side of the track so as to form an oblique sliding surface, a second rail, means supporting the second rail for sliding movement along said oblique surface of the first rail with a portion of said second rail in alignment with said first rail, said second rail being a unitary body of metal having an elastic limit, and means flexing said second rail within said elastic limit to deflect a portion of said second rail into sliding contact with said chamfered end of said first rail while at the same time maintaining said portion of said second rail in alignment with said first rail, wherein said deflecting means comprise guide rollers disposed on opposite sides of and in rolling contact with said second rail, said guide rollers having vertical axes.

2. A track as claimed in claim 1, wherein said guide rollers contact opposite sides of said portion of said second track in alignment with said first track, and also a portion of said second track that is out of contact with said oblique sliding surface and is disposed at an acute angle to said first track.

3. A track as claimed in claim 1, wherein said deflecting means comprise rollers rotatable about vertical axes and in contact with a portion of said second rail that is in contact with said oblique sliding surface and that is disposed on a side of said second rail opposite said oblique sliding surface.

4. A track as claimed in claim 1, wherein said second rail has a head and a base flange and said base flange has a width about equal to a width of said head.

5. A track as claimed in claim 1, wherein said second rail has an end portion disposed at an acute angle to said first rail, and a channel within which said end portion is disposed.

6. A track as claimed in claim 5, and guide rollers in said channel on opposite sides of and in contact with said end portion of said second rail.

7. A track as claimed in claim 1, said portion of said second rail being supported by a longitudinal beam that slides telescopically in a fixed guide channel disposed below said second track.

8. A track as claimed in claim 7, wherein said longitudinal beam and said guide channel have sides that converge upwardly toward said second track.

* * * * *